US009889648B2

(12) United States Patent
Ishida

(10) Patent No.: US 9,889,648 B2
(45) Date of Patent: Feb. 13, 2018

(54) LIQUID EJECTING APPARATUS

(71) Applicant: SEIKO EPSON CORPORATION, Tokyo (JP)

(72) Inventor: Yukimasa Ishida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/005,625

(22) Filed: Jan. 25, 2016

(65) Prior Publication Data

US 2016/0257126 A1 Sep. 8, 2016

(30) Foreign Application Priority Data

Mar. 6, 2015 (JP) ..... 2015-044740

(51) Int. Cl.

| | |
|---|---|
| ***B41J 2/055*** | (2006.01) |
| ***B41J 2/175*** | (2006.01) |
| ***B41J 2/165*** | (2006.01) |
| ***B41J 2/14*** | (2006.01) |

(52) U.S. Cl.

CPC ..... *B41J 2/055* (2013.01); *B41J 2/14233* (2013.01); *B41J 2/1652* (2013.01); *B41J 2/16538* (2013.01); *B41J 2/175* (2013.01); *B41J 2/17596* (2013.01); *B41J 2002/14419* (2013.01); *B41J 2202/20* (2013.01)

(58) Field of Classification Search

CPC . B41J 2/055; B41J 2/175; B41J 2/1652; B41J 2/16535; B41J 2/17596

See application file for complete search history.

(56) References Cited

U.S. PATENT DOCUMENTS

| | | | | |
|---|---|---|---|---|
| 2004/0183876 | A1 | 9/2004 | Mizuno et al. | |
| 2007/0222829 | A1* | 9/2007 | Stathem | B41J 2/17513 347/85 |
| 2009/0073241 | A1 | 3/2009 | Sim et al. | |
| 2011/0193914 | A1 | 8/2011 | Yamada et al. | |
| 2015/0174897 | A1* | 6/2015 | Arimoto | B41J 2/175 347/6 |

FOREIGN PATENT DOCUMENTS

| | | |
|---|---|---|
| JP | 2004-237502 | 8/2004 |
| JP | 2009-073176 | 4/2009 |
| JP | 2011-161827 | 8/2011 |
| JP | 2011-173361 | 9/2011 |
| JP | 2011-189636 | 9/2011 |
| JP | 2014-024347 | 2/2014 |

* cited by examiner

*Primary Examiner* — Justin Seo
(74) *Attorney, Agent, or Firm* — Workman Nydegger

(57) ABSTRACT

A liquid ejecting apparatus includes a plurality of pressure chambers which generate a pressure for ejecting liquid from a nozzle; a common liquid chamber which stores liquid which is supplied to the plurality of pressure chambers; a flexible film which configures a part of a wall face of the common liquid chamber; a damper chamber which is partitioned from the common liquid chamber using the flexible film; and a first pressurizing unit which pressurizes the damper chamber.

21 Claims, 11 Drawing Sheets

LIQUID EJECTING APPARATUS

The entire disclosure of Japanese Patent Application No: 2015-044740, filed Mar. 6, 2015 is expressly incorporated by reference herein in its entirety.

BACKGROUND

1. Technical Field

The present invention relates to a technology in which liquid such as ink is ejected.

2. Related Art

In a liquid ejecting apparatus such as an ink jet printer, a liquid ejecting head with a structure in which liquid such as ink which is supplied to a plurality of pressure chambers from a common liquid chamber (reservoir) is ejected from nozzles by generating a pressure in each pressure chamber has been proposed in the related art. Since a plurality of pressure chambers communicate with the common liquid chamber, a technology in which a damper chamber (also referred to as compliance space) is provided in the common liquid chamber through a flexible film has also been proposed so that a pressure change in each pressure chamber does not have an influence on a separate pressure chamber through the common liquid chamber. In this manner, the damper chamber functions as a damper which causes a flexible film to absorb a delicate pressure change in the common liquid chamber in a normal state such as at a time of printing.

However, there is a case in which such a flexible film of a damper chamber is excessively bent. Specifically, there is a case in which a pressure change which is different from a normal state occurs in a common liquid chamber. For example, there is a case in which, when cleaning an ejecting face of a liquid ejecting head, pressurizing wiping in which the ejecting face is wiped while causing ink to be oozed out from a nozzle by pressurizing the inside of the liquid ejecting head is performed (JP-A-2011-173361 and JP-A-2011-161827). Though it is not described in JP-A-2011-173361 and JP-A-2011-161827, when the pressurizing wiping is going to be performed in an apparatus which includes the above described common liquid chamber, it is necessary to forcibly pressurize the common liquid chamber in order to cause ink to be oozed out from the nozzle. In such a case, excessive bending easily occurs in the flexible film of the damper chamber. When the flexible film is excessively bent, there is a concern that the flexible film may lose its function by sticking to the inside of the damper chamber, or may be separated. In addition, also in a case in which slippage or wrinkle occurs when attaching the flexible film, in addition to that, excessive bending easily occurs in the flexible film of the damper chamber.

SUMMARY

An advantage of some aspects of the invention is to suppress excessive bending of a flexible film of a damper chamber.

Aspect 1

A liquid ejecting apparatus according to a preferable aspect (Aspect 1) of the invention includes a plurality of pressure chambers which generate a pressure for ejecting liquid from a nozzle; a common liquid chamber which stores liquid which is supplied to the plurality of pressure chambers; a flexible film which configures a part of a wall face of the common liquid chamber; a damper chamber which is partitioned from the common liquid chamber using the flexible film; and a first pressurizing unit which pressurizes the damper chamber. In Aspect 1, since the first pressurizing unit which pressurizes the damper chamber is included, it is possible to suppress excessive bending of the flexible film by pressurizing the damper chamber using the first pressurizing unit, even when the common liquid chamber is forcibly pressurized at a time of a pressurizing wiping operation, or the like, for example.

Aspect 2

In a preferable example (Aspect 2) of Aspect 1, a second pressurizing unit which pressurizes liquid which is supplied to the common liquid chamber is further included. In Aspect 2, since the second pressurizing unit which pressurizes liquid which is supplied to the common liquid chamber is further included, it is possible to increase a pressurizing effect of the common liquid chamber compared to a case in which the common liquid chamber is forcibly pressurized using only the first pressurizing unit.

Aspect 3

In a preferable example (Aspect 3) of Aspect 2, pressurizing of the damper chamber using the first pressurizing unit is performed before pressurizing using the second pressurizing unit. In Aspect 3, since pressurizing of the damper chamber using the first pressurizing unit is performed before pressurizing using the second pressurizing unit, it is possible to bend the flexible film to the common liquid chamber side, before pressurizing the common liquid chamber using the second pressurizing unit. In this manner, it is possible to effectively suppress excessive bending of the flexible film when the common liquid chamber is pressurized using the second pressurizing unit.

Aspect 4

In any one preferable example (Aspect 4) of Aspects 1 to 3, an atmosphere opening port which causes an inside of the damper chamber to communicate with atmosphere, and an on-off valve which is provided between the damper chamber and the atmosphere opening port are further included. In Aspect 4, since the atmosphere opening port which causes the inside of the damper chamber to communicate with atmosphere, and the on-off valve which is provided between the damper chamber and the atmosphere opening port are provided, it is possible to set the damper chamber to a closed space by shutting off the damper chamber from atmosphere by closing the on-off valve. It is possible to effectively suppress bending of the flexible film by pressurizing the damper chamber which is a closed space.

Aspect 5

In a preferable example (Aspect 5) of Aspect 4, pressurizing of the damper chamber using the first pressurizing unit is performed after closing the on-off valve. In aspect 5, since pressurizing of the damper chamber using the first pressurizing unit is performed after closing the on-off valve, it is possible to pressurize the damper chamber using the first pressurizing unit, after setting the damper chamber to a closed space which is shut off from atmosphere by closing the on-off valve. In this manner, it is possible to increase pressurizing efficiency of the damper chamber compared to a case in which the damper chamber is pressurized using the first pressurizing unit without being shut from atmosphere.

Aspect 6

In a preferable example (Aspect 6) of Aspect 4 or 5, when finishing pressurizing of the damper chamber, a pressurizing operation of the first pressurizing unit is stopped after opening the on-off valve. When the pressurizing operation of the first pressurizing unit is stopped, a pressure of the damper chamber drops from stopping of the pressurizing operation. For this reason, if water vapor of the damper chamber is saturated at a time of pressurizing, there is a concern that dew condensation may occur when a pressure of the damper chamber drops in a state in which the on-off valve is not opened. In this point, in Aspect 6, since the pressurizing operation of the first pressurizing unit is stopped after opening the on-off valve when finishing pressurizing of the damper chamber, it is possible to suppress an occurrence of dew condensation, since water vapor can be escaped by causing the damper chamber to be opened to atmosphere before stopping the pressurizing operation of the first pressurizing unit.

Aspect 7

In a preferable example (Aspect 7) of Aspect 4 or 5, when finishing pressurizing of the damper chamber, the on-off valve is opened after stopping the pressurizing operation of the first pressurizing unit. If water vapor of the damper chamber is saturated, since water vapor escapes due to opening to atmosphere, there is a concern that moisture loss from the common liquid chamber through the flexible film may progress that much. In this point, in Aspect 7, since the on-off valve is opened after stopping the pressurizing operation of the first pressurizing unit when finishing pressurizing of the damper chamber, it is possible to finish pressurizing of the damper chamber while suppressing escaping of water vapor due to opening to atmosphere.

Aspect 8

In any one preferable example (Aspect 8) of Aspects 1 to 7, a wiping unit which wipes an ejecting face on which a plurality of nozzles are provided is further included, in which the ejecting face is wiped using the wiping unit in the middle of pressurizing the damper chamber using the first pressurizing unit. In Aspect 8, since the ejecting face is wiped using the wiping unit in the middle of pressurizing the damper chamber using the first pressurizing unit, it is possible to suppress excessive bending of the flexible film during the wiping operation. In addition, a preferable example of the liquid ejecting apparatus is a printing apparatus which ejects ink to a medium such as a printing sheet; however, a use of the liquid ejecting apparatus according to the aspects of the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment

Figure 1:
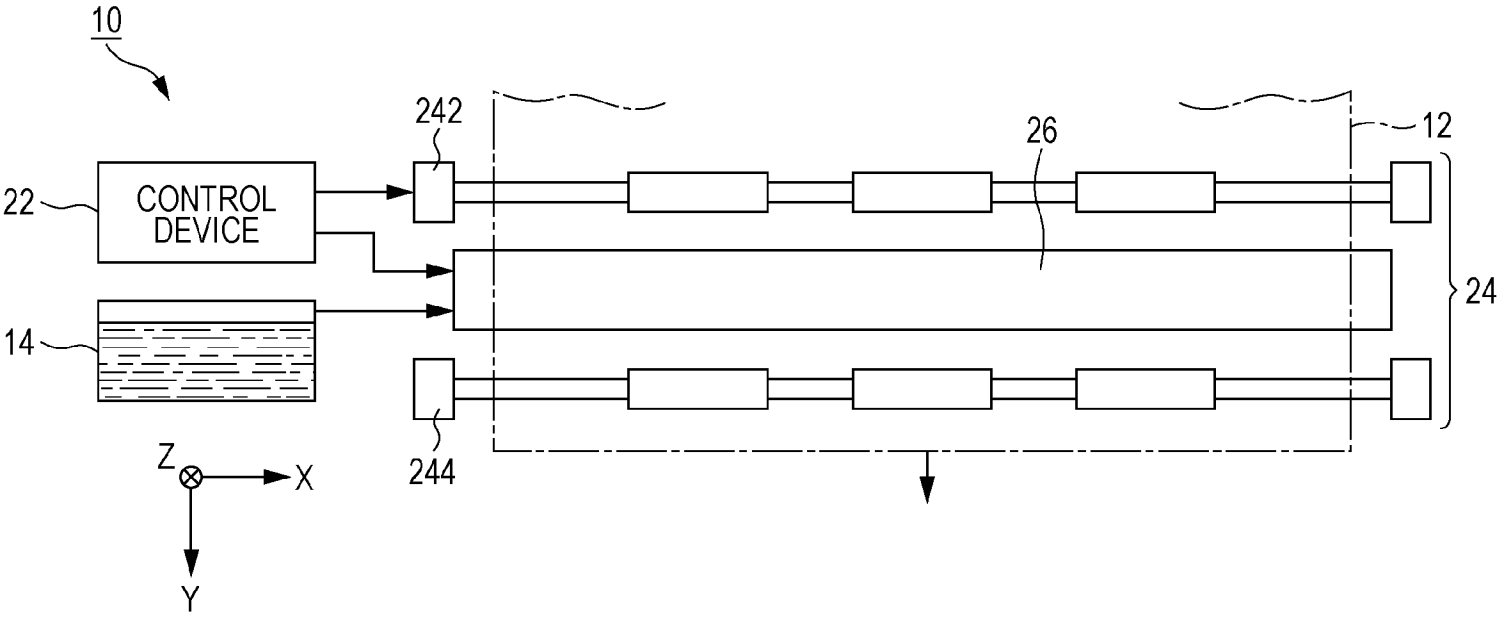
FIG. 1 is a configuration diagram of a printing apparatus to which a liquid ejecting apparatus according to an embodiment of the invention is applied.

First, a liquid ejecting apparatus according to an embodiment of the invention will be described using an ink jet printing apparatus as an example. FIG. 1 is a partial configuration diagram of a printing apparatus 10 according to the embodiment of the invention. The printing apparatus 10 according to the embodiment is a liquid ejecting apparatus which ejects ink as an example of liquid onto a medium (ejecting target) 12 such as a printing sheet, and includes a control device 22, a transport mechanism 24, and a liquid ejecting unit 26. A liquid container (cartridge) 14 which stores ink is mounted on the printing apparatus 10.

The control device 22 integrally controls each element of the printing apparatus 10. The control device 22 includes a CPU, a ROM, a RAM, and the like. Various programs such as a program for performing a pressurizing wiping operation, which will be described later, are stored in the ROM in addition to a program for performing a printing operation which will be executed by the CPU. In addition, various data items for processing an operation result of the CPU, or a control program by executing thereof are temporarily stored in the RAM.

The transport mechanism 24 includes a first roller 242 and a second roller 244, and transports the medium 12 in the Y direction (transport direction) under a control of the control device 22. The first roller 242 transports the medium 12 to the second roller 244 side by being arranged on the negative side in the Y direction (upstream side of medium 12 in transport direction) when viewed from the second roller 244, and the second roller 244 transports the medium 12 which is supplied from the first roller 242 to the positive side in the Y direction. However, a structure of the transport mechanism 24 is not limited to the above example.

Figure 2:
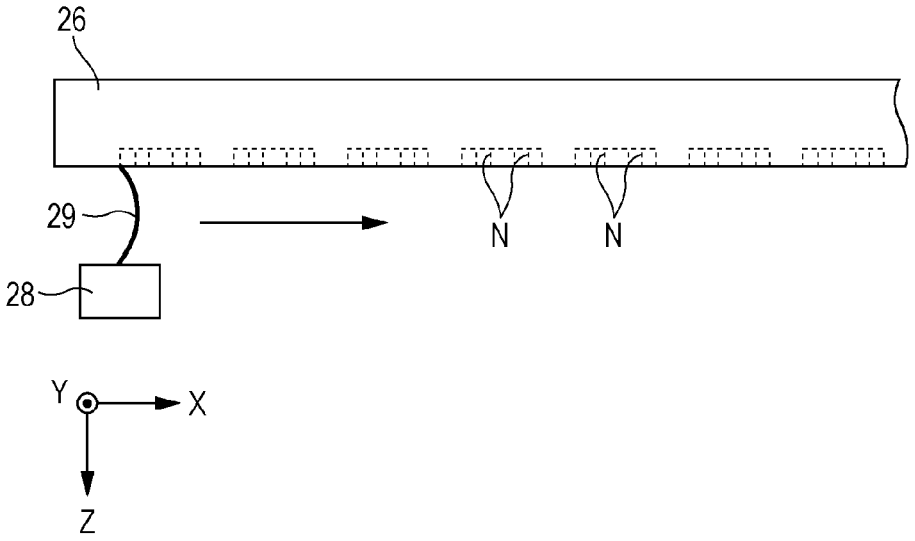
FIG. 2 is an explanatory diagram which describes a wiping operation of the printing apparatus which is illustrated in FIG. 1.

The liquid ejecting unit 26 in FIG. 1 ejects ink which is supplied from the liquid container 14 onto the medium 12 which is transported using the transport mechanism 24 under a control of the control device 22. The liquid ejecting unit 26 according to the embodiment is a line head which is long in the X direction (first direction) which is orthogonal to the Y direction. As illustrated in FIG. 2, a plurality of nozzles (ejecting holes) N from which ink is ejected are provided on a face of the liquid ejecting unit 26 which faces the medium 12 (hereinafter, referred to as "ejecting face").

As illustrated in FIG. 2, the printing apparatus 10 includes a wiping device 28 as a wiping unit for wiping the ejecting face of the liquid ejecting unit 26. The wiping device 28 is used when executing a wiping operation for removing an attached matter such as paper dust, or ink by wiping the ejecting face of the liquid ejecting unit 26. The wiping device 28 includes a wiper 29 which is obtained by forming an elastic member such as rubber in a blade shape. In addition, a shape of the wiper 29 is not limited to the blade shape, and may be a strip shape, for example. The wiping device 28 is configured so as to move in the X direction along the ejecting face of the liquid ejecting unit 26 using a motor which is not illustrated. In this manner, it is possible to perform a wiping operation when the wiping device 28 moves in the X direction along the ejecting face, while a tip end of the wiper 29 is in contact with the ejecting face of the liquid ejecting unit 26. However, the direction in which the wiping device 28 moves is not limited to the X direction, and may be the Y direction.

According to the embodiment, it is configured so that it is possible to perform a pressurizing wiping operation in which the ejecting face is wiped using the wiping device 28, while causing ink to be oozed out from each nozzle N by pressurizing the inside of the liquid ejecting unit 26. The reason for performing such a pressurizing wiping operation is as follows. In wiping of the ejecting face, the tip end of the wiper 29 moves while being in contact with the ejecting face. For this reason, when wiping of the ejecting face is performed without pressurizing the inside of the liquid ejecting unit 26, there is a concern that ink with high viscosity which is attached to the vicinity of the nozzle N may be rubbed in the nozzle N, or bubbles may enter into the nozzle N. Specifically, in a liquid ejecting unit 26 with a long line head, since a cleaning area is wide, and the number of nozzles N is also large, the above described problem easily occurs. In this point, according to the pressurizing wiping operation, it is possible to prevent ink or bubble from entering into the nozzle N, since the ejecting face is wiped while causing ink to be oozed out from each nozzle N, by pressurizing the inside of the liquid ejecting unit 26.

Figure 3:
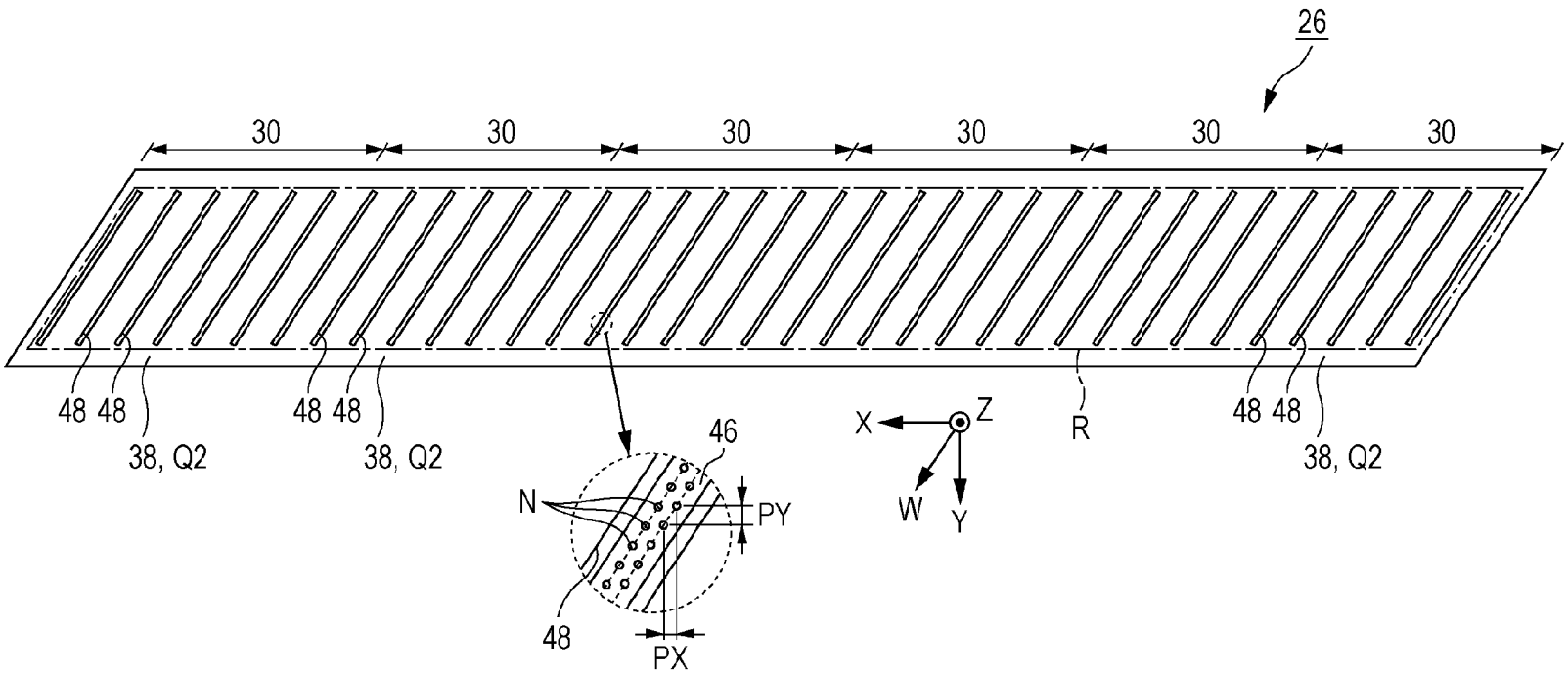
FIG. 3 is a plan view which illustrates a configuration of a face which faces a medium in a liquid ejecting unit including a plurality of liquid ejecting heads.

FIG. 3 is a plan view which illustrates a configuration example of the ejecting face (nozzle face) of the liquid ejecting unit 26. As illustrated in FIG. 3, the plurality of nozzles N are provided on the ejecting face of the liquid ejecting unit 26. The liquid ejecting unit 26 is arranged so that the ejecting face faces the medium 12 with a predetermined interval in a state of being parallel to an X-Y plane. When the liquid ejecting unit 26 ejects ink onto the medium 12 in parallel with transporting of the medium 12 using the transport mechanism 24, a desired image is formed on the surface of the medium 12. In addition, hereinafter, a direction which is orthogonal to the X-Y plane (for example, plane with no deformation which is parallel to surface of medium 12) will be denoted by the Z direction. An ejecting direction of ink using the liquid ejecting unit 26 (for example, vertically lower direction) corresponds to the Z direction. In addition, the transverse direction of a region R of the ejecting face of the liquid ejecting unit 26 in which the plurality of nozzles N are distributed (hereinafter, referred to as "nozzle distribution region") corresponds to the Y direction, and the longitudinal direction of the nozzle distribution region R corresponds to the X direction.

FIG. 3 is a diagram which describes a configuration example of the liquid ejecting unit 26, and is a plan view which illustrates a face which faces the medium 12. As illustrated in FIG. 3, the liquid ejecting unit 26 according to the embodiment includes a plurality of (six, here) liquid ejecting heads 30. The plurality of liquid ejecting heads 30 are fixed to a housing (not illustrated) of the liquid ejecting unit 26 in a state of being arranged along the X direction.

Figure 4:
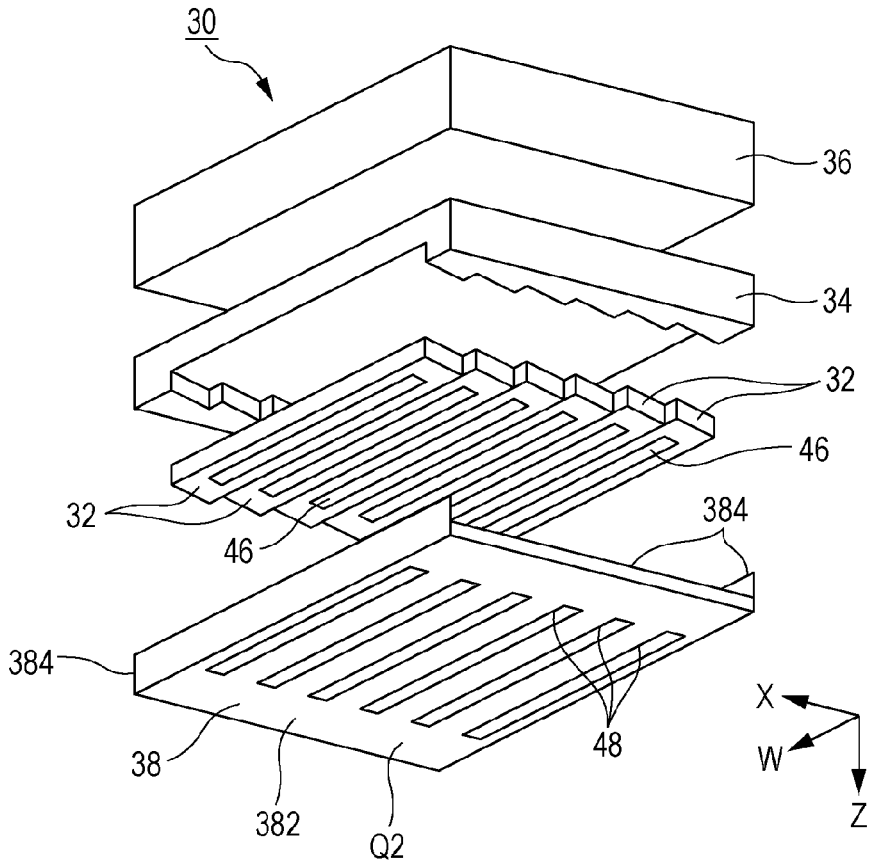
FIG. 4 is an exploded perspective view which illustrates a configuration example of one liquid ejecting head in the liquid ejecting unit which is illustrated in FIG. 3.

Subsequently, a configuration example of the liquid ejecting head 30 which is illustrated in FIG. 3 will be described in detail with reference to FIG. 4. FIG. 4 is an exploded perspective view which illustrated the configuration example of the liquid ejecting head 30. In addition, since all of six liquid ejecting heads 30 which are illustrated in FIG. 3 have the same configuration, one liquid ejecting head 30 will be extracted, and a portion thereof which corresponds to one nozzle N will be representatively described here. As illustrated in FIG. 4, the liquid ejecting head 30 includes a liquid ejecting unit 32, a support body 34, a flow path structure body 36, and a fixing plate 38. The support body 34 is a housing which accommodates and supports a plurality of the liquid ejecting units 32, and is formed using injection molding of a resin material, or diecast molding of a metal material, for example. In addition, the support body forms a flow path of ink which is supplied to the plurality of liquid ejecting units 32. The flow path structure body 36 is a structure body in which a flow path for distributing ink which is supplied from the liquid container 14 to the plurality of liquid ejecting units 32 is formed, and includes, for example, a valve structure for controlling opening-closing of a flow path or a pressure, or a filter for collecting bubbles or foreign substances which are mixed into ink in the flow path. In addition, it is also possible to integrally form the support body 34 and the flow path structure body 36.

Each liquid ejecting unit 32 is configured as a head chip which ejects ink from the plurality of nozzles N. As illustrated in FIG. 3, the plurality of nozzles N of each liquid ejecting unit 32 are arranged in two columns along the W direction which intersects the X direction. As illustrated in FIG. 3, the W direction according to the embodiment is a direction which is inclined in a predetermined angle (for example, angle in range of 30° C. or more and 60° C. or less) with respect to the X direction and Y direction in the X-Y plane. According to the embodiment, as illustrated in FIG. 3, positions of the plurality of nozzles N are selected so that a pitch PX in the X direction (specifically, distance between centers of each nozzle N) becomes smaller than a pitch PY in the Y direction (PX<PY). As the above described example, according to the embodiment, since the plurality of nozzles N are arranged in the W direction which is inclined to the Y direction in which the medium 12 is transported, it is possible to increase a practical resolution (dot density) of the medium 12 in the X direction, compared to a configuration in which the plurality of nozzles N are arranged along the X direction, for example.

Figure 5:
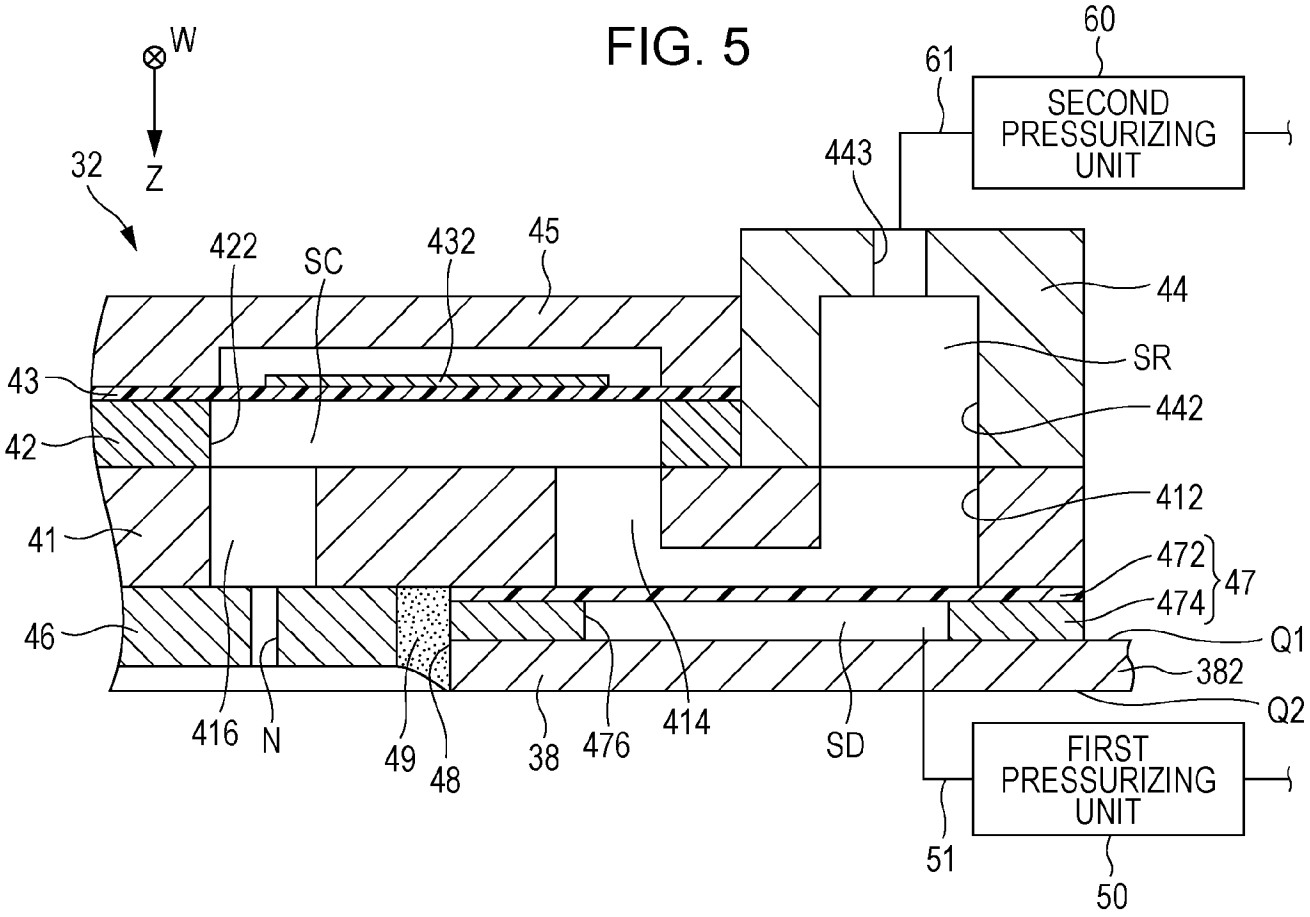
FIG. 5 is a sectional view of a portion of the liquid ejecting unit which is illustrated in FIG. 4, corresponding to one nozzle.

Here, a configuration example of the liquid ejecting unit 32 which is illustrated in FIG. 4 will be described in detail with reference to FIG. 5. In addition, since all of the plurality of liquid ejecting units 32 illustrated in FIG. 4 have the same configuration, descriptions will be made by extracting one of the liquid ejecting unit. FIG. 5 is a sectional view which illustrates a configuration of a section of the liquid ejecting unit 32 which is orthogonal to the W direction in a portion of the liquid ejecting unit 32 which corresponds to one nozzle N. In FIG. 5, a portion of the liquid ejecting unit 32 which corresponds to one nozzle N is conveniently illustrated; however, the liquid ejecting unit 32 here includes two nozzles N, and is configured by arranging structures which eject ink by supplying the ink to each nozzle N in linear symmetry, respectively, with respect to a symmetry axis which is parallel in the W direction. However, the liquid ejecting unit 32 is not necessarily limited to the configuration, may be a unit which is formed of a structure corresponding to one nozzle N, or may have a configuration in which nozzles N are arranged in zigzag in the W direction between two columns which go along the W direction.

As illustrated in FIG. 5, the liquid ejecting unit 32 according to the embodiment is a layered structure body. The liquid ejecting unit 32 includes a flow path substrate 41 as an example of a flow path member. A pressure chamber substrate 42, a vibrating plate 43, a housing 44, and a sealing plate 45 are arranged on one side (negative side in Z direction) of the flow path substrate 41. A nozzle plate 46, and a compliance unit 47 are arranged on the other side of the flow path substrate 41. Each element of the liquid ejecting unit 32 is an approximately flat plate-shaped member which is long in the W direction, schematically, and is fixed to each other using an adhesive, for example.

The nozzle plate 46 in FIG. 5 is a substrate on which the plurality of nozzles N are formed. The nozzle plate 46 according to the embodiment is a flat plate which is long in the W direction as is understood from FIG. 4, as well, and is formed using a silicon single crystal substrate, for example. Specifically, as illustrated in FIG. 3, the plurality of nozzles N which are arranged in two columns along the W direction are formed on the nozzle plate 46 of each liquid ejecting unit 32.

The flow path substrate 41 in FIG. 5 is a flat plate which configures a flow path of ink. An opening portion 412, a supply flow path 414, and a communicating flow path 416 are formed in the flow path substrate 41 in the embodiment. The supply flow path 414 and the communicating flow path 416 are through holes which are formed in each nozzle N, and the opening portion 412 is a through hole which is continuous over the plurality of nozzles N. A space which causes an accommodating unit (recessed portion) 442 which is formed in the housing 44 and the opening portion 412 of the flow path substrate 41 to communicate with each other functions as a common liquid chamber SR (reservoir or manifold) which stores ink which is supplied from the liquid container 14 through a introducing flow path 443 of the housing 44.

The compliance unit 47 in FIG. 5 is an element for controlling a pressure change of ink in the common liquid chamber SR, and includes a flexible film (elastic film) 472, and a support plate 474. The flexible film 472 is a flexible member which is formed in a film shape, and configures a part of a wall face (specifically, base) of the common liquid chamber SR. The support plate 474 is a flat plate which is formed of a high rigidity material such as stainless steel (SUS), and supports the flexible film 472 on the surface of the flow path substrate 41 so that the opening portion 412 of the flow path substrate 41 is shut off using the flexible film 472. An opening portion 476 is formed in a region of the support plate 474 which overlaps the common liquid chamber SR by interposing the flexible film 472 therebetween. A space in the inside of the opening portion 476 of the support plate 474 communicates with atmosphere, and functions as a damper chamber SD for deforming the flexible film 472 so that a pressure change in the common liquid chamber SR is absorbed. When the flexible film 472 is deformed according to a pressure of ink in the common liquid chamber SR, a pressure change in the common liquid chamber SR is suppressed (absorbed).

An opening portion 422 is formed in each nozzle N in the pressure chamber substrate 42 in FIG. 5. The vibrating plate 43 is a flat plate which can be elastically vibrated, and is fixed to the surface of the pressure chamber substrate 42 on a side opposite to the flow path substrate 41. A space which is interposed between the vibrating plate 43 and the flow path substrate 41 in the inside of each opening portion 422 of the pressure chamber substrate 42 functions as a pressure chamber (cavity) SC which is filled with ink supplied from the common liquid chamber SR through the supply flow path 414. Each pressure chamber SC communicates with a nozzle N through the communicating flow path 416 of the flow path substrate 41. In addition, a piezoelectric element 432 is formed in each nozzle N on the surface of the vibrating plate 43 on a side opposite to the pressure chamber substrate 42. Each piezoelectric element 432 is a driving element which is obtained by interposing a piezoelectric element layer between electrode layers which face each other. A plurality of the piezoelectric elements 432 are sealed with the sealing plate 45. However, a configuration of the liquid ejecting unit 32 is not limited to the above described configuration, and for example, may be a configuration in which the vibrating plate 43 and the pressure chamber substrate 42 are integrally formed, and a part of the pressure chamber substrate 42 is elastically vibrated. That is, as the liquid ejecting unit 32, it is preferable when ink in the common liquid chamber SR of which a part of wall face is configured by the flexible film 472 can be ejected through the pressure chamber (cavity) SC and the nozzle N.

The plurality of liquid ejecting units 32 with the above exemplified structure are fixed to the fixing plate 38 in FIG. 4. As illustrated in FIG. 4, the fixing plate 38 includes a support unit 382 and a plurality of peripheral edge portions 384. The support unit 382 is a flat plate-shaped portion which includes a first face Q1 and a second face Q2 which are located on a side opposite to each other. The support unit 382 is molded in a rectangular shape (specifically, parallelogram shape) which is defined by a pair of edges which extend in the W direction, and a pair of edges which extend in the X direction. The first face Q1 of the support unit 382 is the surface on the negative side in the Z direction, and the second face Q2 is the surface on the positive side (medium 12 side) in the Z direction. The second face Q2 of the support unit 382 is subjected to water-repellent finishing. Meanwhile, each peripheral edge portion 384 is a portion which is continuous to each edge of the support unit 382, and is bent on the negative side in the Z direction so as to be approximately orthogonal to the first face Q1 or the second face Q2 of the support unit 382. The support unit 382 and a plurality of the peripheral edge portions 384 are integrally configured by bending a flat plate which is formed in a predetermined shape using a high rigidity material such as stainless steel, for example.

As illustrated in FIG. 5, the plurality of liquid ejecting units 32 of the liquid ejecting head 30 are fixed to the first face Q1 of the support unit 382 of the fixing plate 38 so that the nozzle plate 46 is exposed to an opening portion 48 of the fixing plate 38. In addition, each peripheral edge portion 384 of the fixing plate 38 is fixed to the support body 34 which is illustrated in FIG. 4 using an adhesive, for example, in a state in which the plurality of liquid ejecting units 32 are fixed onto the first face Q1 of the support unit 382 in this manner. As illustrated in FIG. 3, the plurality of liquid ejecting heads 30 with the above exemplified structure are arranged in the X direction in a state of facing the second face Q2 of the fixing plate 38 on the positive side in the Z direction. As is understood from the above descriptions, a plane which is configured using the second face Q2 of the plurality of liquid ejecting heads 30 corresponds to the ejecting face.

As illustrated in FIG. 4, the opening portion 48 which exposes the nozzle plate 46 according to the embodiment is formed on the support unit 382 of the fixing plate 38 which configures a face facing the medium 12. In the support unit 382, the plurality of (six, here) opening portions 48 which correspond to each liquid ejecting unit 32 are formed, and each opening portion 48 is arranged in the X direction with a predetermined interval each other. Each opening portion 48 is a long through hole which extends along the W direction in a planar view (when viewed in direction which is perpendicular to Z direction). As illustrated in FIG. 3, each liquid ejecting unit 32 is fixed to the first face Q1 of the support unit 382 in a state in which the nozzle plate 46 of each liquid ejecting unit 32 is located in the inside of one opening portion 48. As is understood from the above descriptions, each opening portion 48 of the fixing plate 38 is a through hole for exposing the plurality of nozzles N of each liquid ejecting unit 32. As illustrated in FIG. 5, a space in the inside of the opening portion 48 (specifically, gap between inner peripheral face of opening portion 48 and outer peripheral face of nozzle plate 46) is filled with a filling material 49 which is formed of a resin material, for example.

As illustrated in FIG. 5, according to the embodiment, the surface of the support plate 474 of the compliance unit 47 on a side opposite to the flexible film 472 is fixed to the first face Q1 of the fixing plate 38 using an adhesive, for example. That is, the opening portion 476 of the support plate 474 is shut off using the first face Q1 of the fixing plate 38. A space which is interposed between the flexible film 472 and the first face Q1 in the inside of the opening portion 476 of the support plate 474 becomes the damper chamber SD for vibrating the flexible film 472. As described above, the flexible film 472 of the damper chamber SD can suppress a pressure change of the pressure chamber SC of another nozzle N, since a pressure change in the common liquid chamber SR is suppressed (absorbed) when the flexible film is deformed according to a pressure of ink in the common liquid chamber SR. In this manner, the flexible film 472 of the damper chamber SD is originally a film to be deformed so that a pressure change in the common liquid chamber SR is absorbed.

However, there is a case in which the inside of the common liquid chamber SR is forcibly pressurized such as a case in which the above described pressurizing wiping operation is performed, for example, and in such a case, there is a concern that the flexible film 472 may be excessively deformed.

Figure 6:
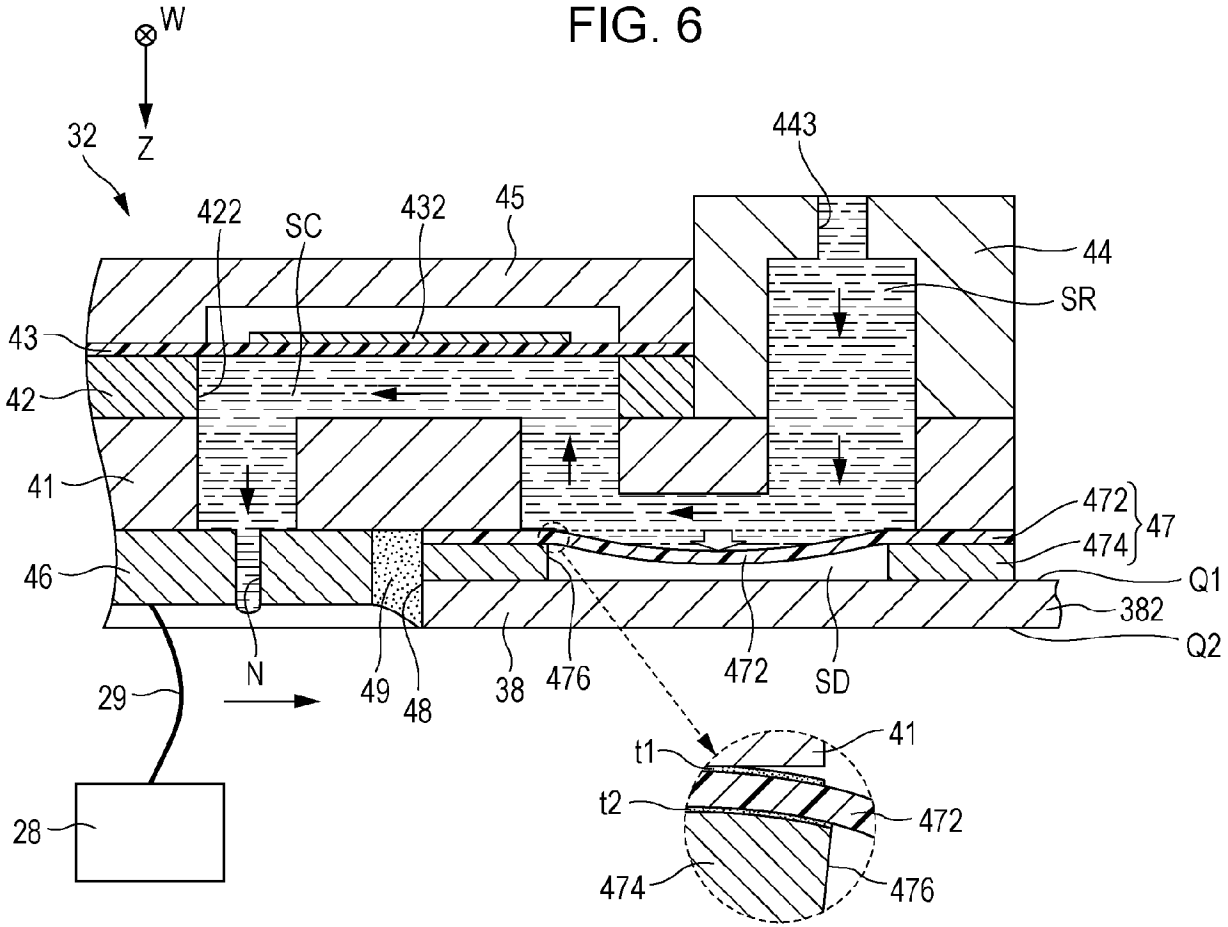
FIG. 6 is a diagram which illustrates a comparison example in which a first pressurizing unit which pressurizes a damper chamber is not provided, and an explanatory diagram of a pressurizing wiping operation.

The case in which the flexible film 472 is excessively deformed at a time of such a pressurizing wiping operation will be described more specifically, as a comparison example. FIG. 6 is an explanatory diagram of an operation in a comparison example for describing the case in which the flexible film 472 is excessively deformed at a time of the pressurizing wiping operation. As illustrated in FIG. 6, when performing the pressurizing wiping operation, ink is oozed out from a nozzle N when the ink in the common liquid chamber SR is pressurized. For this reason, ink projects without recessing of the vicinity of an outlet in the nozzle N. It is possible to prevent ink or bubbles from entering into the nozzle N, by wiping the ejecting face using the wiper 29 by driving the wiping device 28 in this state.

However, since ink in the common liquid chamber SR is pressurized at a time of the pressurizing wiping operation, the flexible film 472 is excessively deformed in a direction of the white arrow so as to be recessed in the damper chamber SD. At this time, when deformation of the flexible film 472 is remarkable, there is a problem in that the flexible film does not normally function by sticking to a wall of the damper chamber SD, or the flexible film 472 is separated as illustrated in the enlarged view in FIG. 6. The flexible film 472 is attached to the flow path substrate 41 using an adhesive t1, and is attached to the support plate 474 using an adhesive t2. In this case, the support plate 474 is formed of a high rigidity material such as stainless steel (SUS); however, the support plate is extremely thin compared to the flow path substrate 41. For this reason, as illustrated in the enlarged view in FIG. 6, since the support plate is easily bent along with the flexible film 472, there is a concern that the flexible film 472 may be previously separated from the flow path substrate 41.

Therefore, according to the embodiment, it is set so that such an excessive deformation of the flexible film 472 can be suppressed by providing a first pressurizing unit 50, as a pressurizing mechanism, which pressurizes the damper chamber SD, as illustrated in FIG. 5. Pressurizing of ink in the common liquid chamber SR according to the embodiment is performed using a second pressurizing unit 60 which is provided in the liquid supply flow path 61 which supplies ink by communicating with the liquid container (cartridge) 14. According to the embodiment, the damper chamber SD is pressurized using the first pressurizing unit 50 before pressurizing ink in the common liquid chamber SR using the second pressurizing unit 60. In this manner, it is possible to prevent the flexible film 472 from being excessively bent to the damper chamber SD due to a pressure from the damper chamber SD, even when ink in the common liquid chamber SR is pressurized. In addition, since bending of the flexible film 472 can be suppressed, it is possible to improve a response when pressurizing ink in the common liquid chamber SR.

Figure 7:
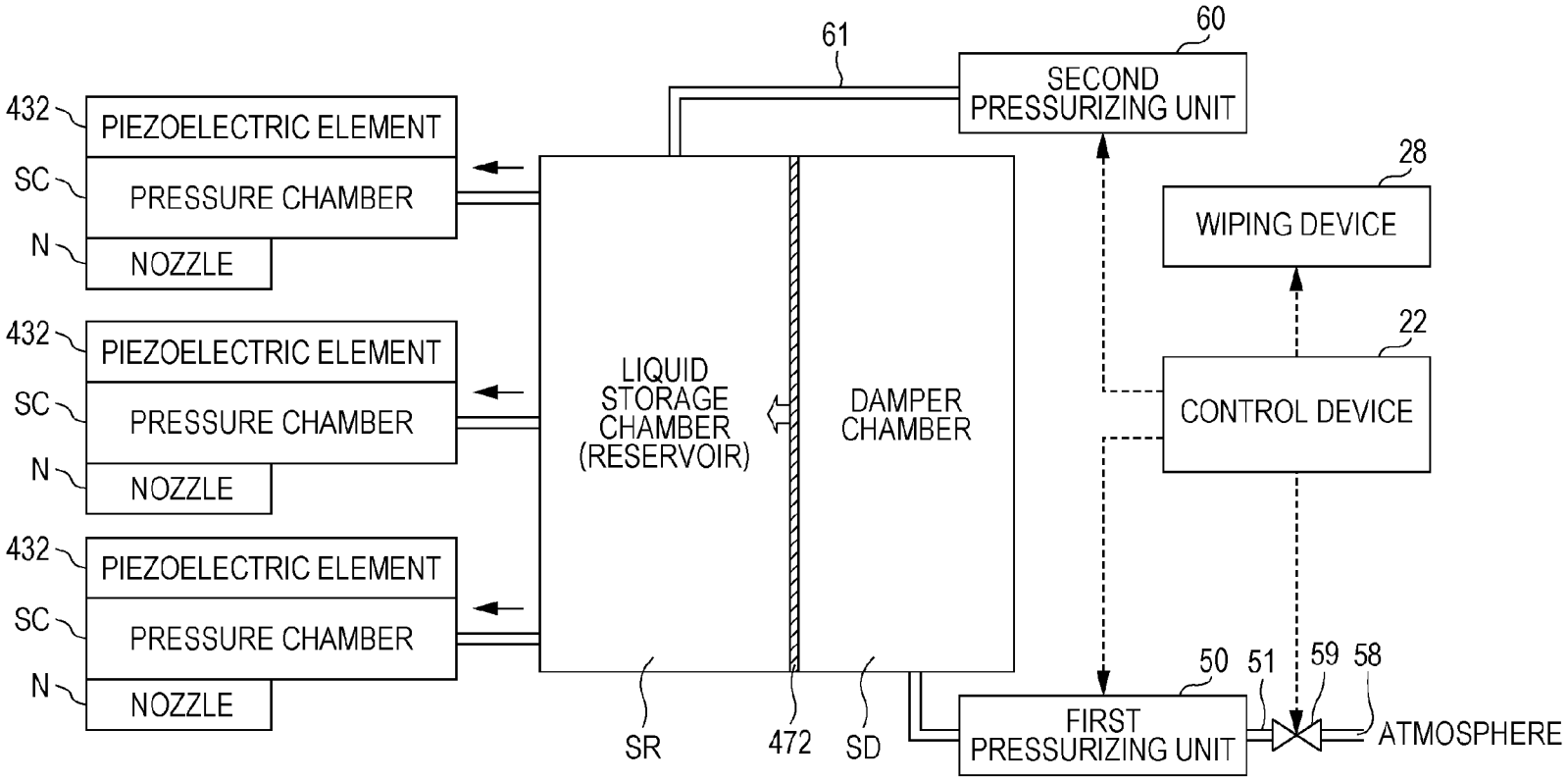
FIG. 7 is a block diagram which describes a pressurizing function according to the embodiment.

A pressurizing mechanism in the embodiment will be more specifically described with reference to drawings. FIG. 7 is a block diagram which illustrates a configuration of a pressurizing mechanism in the embodiment. The block diagram illustrated in FIG. 7 is a block diagram in which a configuration of each unit illustrated in FIG. 5 is denoted so that a flow of a pressurizing operation is easily understood. In FIG. 7, portions with the same function as those illustrated in FIG. 5 are given the same reference numerals, and detailed descriptions thereof will be omitted. As illustrated in FIG. 7, in the common liquid chamber SR, ink which is pressurized is supplied from the second pressurizing unit 60 through the liquid supply flow path 61, and is temporarily stored. A plurality of the pressure chambers SC communicate with the common liquid chamber SR, and ink which is stored in the common liquid chamber SR is supplied to each pressure chamber SC. Each pressure chamber SC causes ink to be ejected from the nozzle N using a pressure which is generated by the piezoelectric elements 432.

The flexible film 472 configures a part of the wall face of the common liquid chamber SR. The damper chamber SD is partitioned from the common liquid chamber SR due to the flexible film 472. The first pressurizing unit 50 which pressurizes the damper chamber SD is connected to the damper chamber SD. Specifically, a communicating path 51 which includes an atmosphere opening port 58 which causes the damper chamber SD to communicate with atmosphere is connected to the damper chamber SD, and the first pressurizing unit 50 is intervened in the middle of the communicating path 51. In addition, in the communicating path 51, an on-off valve 59 for shutting or opening the damper chamber SD with respect to atmosphere is intervened between the first pressurizing unit 50 and the atmosphere opening port 58. It is possible to set the damper chamber SD to a closed space by shutting the damper chamber SD from atmosphere by closing the on-off valve 59. By pressurizing the damper chamber SD as the closed space, it is possible to effectively suppress bending of the flexible film 472. The control device 22 performs the pressurizing wiping operation by controlling the first pressurizing unit 50, the second pressurizing unit 60, the on-off valve 59, and the wiping device 28. The pressurizing wiping operation according to the embodiment in which the pressurizing mechanism is used will be described in detail later.

Figure 8:
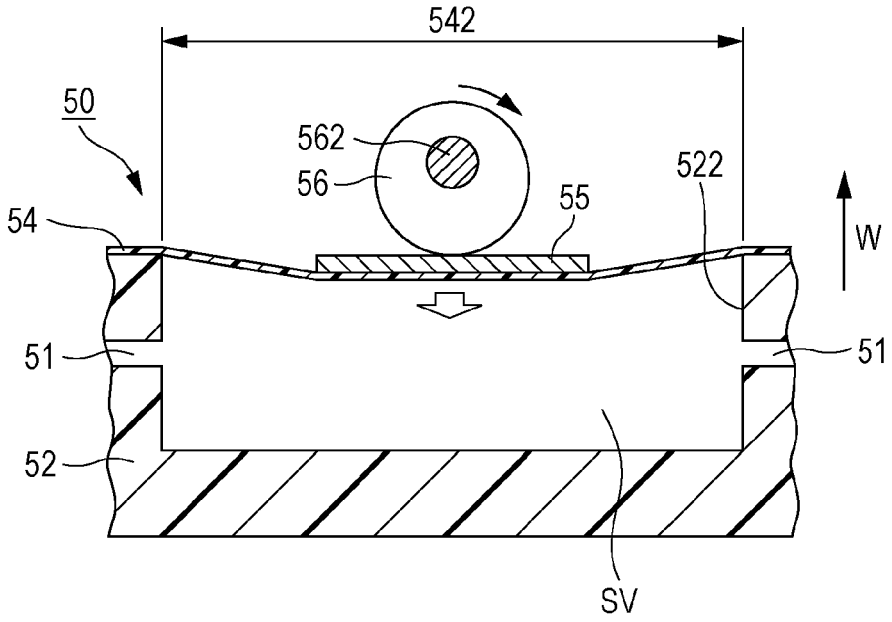
FIG. 8 is a sectional view which illustrates a specific configuration example of the first pressurizing unit according to the embodiment.

Subsequently, a specific configuration example of the first pressurizing unit 50 will be described. FIG. 8 is a sectional view which illustrates a specific configuration example of the first pressurizing unit 50. The first pressurizing unit 50 illustrated in FIG. 8 is configured so as to pressurize the damper chamber SD which communicates with a buffer chamber by changing a volume of the buffer chamber SV which is provided in the middle of the communicating path 51 which causes the damper chamber SD to communicate with the atmosphere opening port 58. Specifically, the first pressurizing unit 50 illustrated in FIG. 8 includes a support body 52 and a sealing body 54. A recessed portion 522 is formed in the support body 52, and the sealing body 54 is fixed to the support body 52 so as to close an opening of the recessed portion 522. The support body 52 is a structure body which is formed of a resin material such as polypropylene (PP) using injection molding, for example. A space which is surrounded with the recessed portion 522 and the sealing body 54 functions as the buffer chamber SV.

The sealing body 54 is a member in a thin plate shape (film shape) which is formed of a resin material such as polypropylene, similarly to the support body 52, for example, and is welded or bonded to the surface of the support body 52. A portion of the sealing body 54 which is located inside the recessed portion 522 in a planar view is referred to as a movable unit 542 here. A pressure receiving plate 55 is provided on the surface of the movable unit 542 on a side opposite to the support body 52, and an eccentric cam 56 is arranged so as to face the pressure receiving plate 55. The eccentric cam 56 is attached to a driving rod 562 which is rotatably driven by being suspended on a direction perpendicular to the W direction in an eccentric manner.

The eccentric cam 56 rotates due to the driving rod 562, and performs an operation of pressing the pressure receiving plate 55 to the support body 52 side. Due to the operation, the movable unit 542 of the sealing body 54 is also displaced in the same direction, the buffer chamber SV is pressurized, and the damper chamber SD which communicates with the buffer chamber is pressurized. In this manner, according to the first pressurizing unit 50 with the configuration which is illustrated in FIG. 8, it is possible to pressurize the damper chamber SD by rotating the eccentric cam 56. In this manner, it is possible to control bending of the flexible film 472 of the damper chamber SD.

Figure 9:
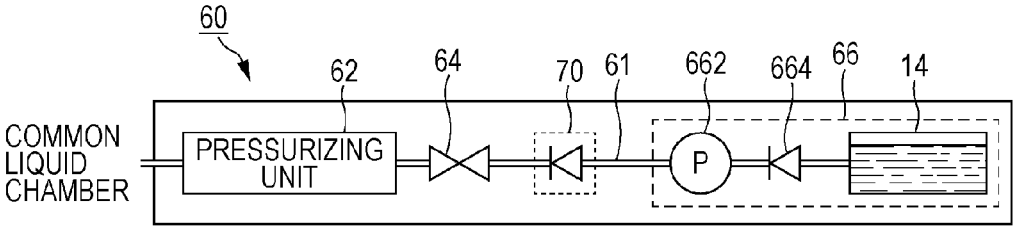
FIG. 9 is a sectional view which illustrates a specific configuration example of a second pressurizing unit according to the embodiment.

Subsequently, a specific configuration example of the second pressurizing unit 60 will be described. FIG. 9 is a sectional view which illustrates a specific configuration example of the second pressurizing unit 60. As illustrated in FIG. 9, the second pressurizing unit 60 includes a liquid pressure-feeding unit 66 which pressure-feeds ink through a pressurizing unit 62, an on-off valve 64, a pressure adjusting valve 70, and the liquid supply flow path 61 in the liquid supply flow path 61 which causes the common liquid chamber SR and the liquid container 14 to communicate. The pressurizing unit 62 pressurizes liquid in the common liquid chamber SR by forcibly pressurizing liquid in the liquid supply flow path 61. Since the pressurizing unit 62 is similarly configured as that in FIG. 8, detailed descriptions will be omitted. However, the configuration of the pressurizing unit 62 is not limited to that which is illustrated in FIG. 8. The liquid pressure-feeding unit 66 includes the liquid container 14, and a pressurizing pump (for example, diaphragm pump) 662 which pressure-feeds ink which is stored in the liquid container 14 to the liquid supply flow path 61. A check valve 664 is interposed between the liquid container 14 and the pressurizing pump 662 in order to prevent ink from flowing backward to the liquid container 14.

The pressure adjusting valve 70 includes a valve mechanism which causes the liquid pressure-feeding unit 66 on the upstream side and the common liquid chamber SR on the downstream side to communicate according to a pressure change on the downstream side. According to this, when a negative pressure on the downstream side is small, the valve is closed, and the liquid pressure-feeding unit 66 and the common liquid chamber SR enter a sealed state which is a non-communicating state. When ink is consumed in a printing state, and a pressure on the common liquid chamber SR side drops, the valve is open, the liquid pressure-feeding unit 66 and the common liquid chamber SR communicate, and ink is supplied to the common liquid chamber SR. In addition, when the pressure drop is resolved, the valve is closed again, the liquid pressure-feeding unit 66 and the common liquid chamber SR enter the non-communicating state, and supplying of ink is stopped.

Since the downstream side of the pressure adjusting valve 70 is shut off when the on-off valve 64 is closed, it is possible to set so that the pressure adjusting function in which a valve is open according to a pressure change on the downstream side is not operated temporarily. In this manner, it is possible to increase pressurizing efficiency by performing forcible pressurizing using the pressurizing unit 62, after closing the on-off valve 64. This point will be described in detail later.

Figure 10:
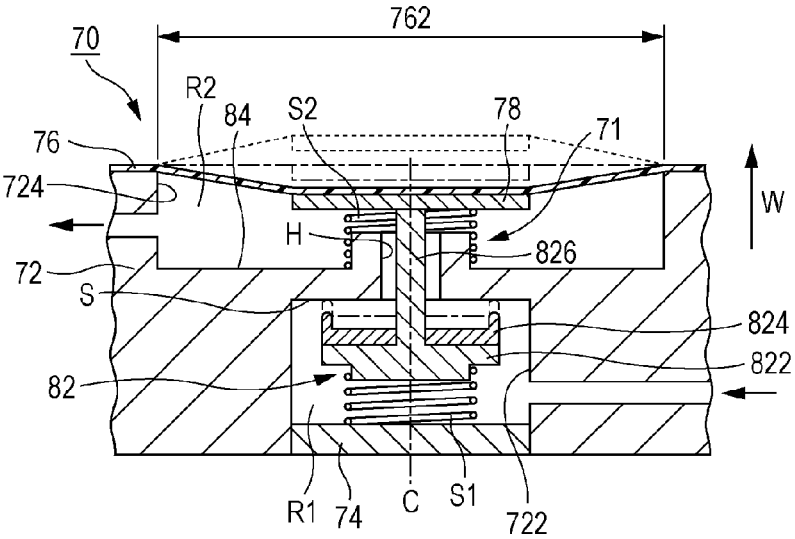
FIG. 10 is a sectional view which illustrates a specific configuration example of a pressure adjusting valve illustrated in FIG. 9.

Here, a specific configuration example of the pressure adjusting valve (self-sealing valve) 70 will be described. FIG. 10 is a sectional view which illustrates the specific configuration example of the pressure adjusting valve 70 which is illustrated in FIG. 9. The pressure adjusting valve 70 illustrated in FIG. 10 includes a valve unit 71 which is provided in the liquid supply flow path 61. The valve unit 71 is a valve mechanism which is provided between a first flow path R1 which communicates with the liquid supply flow path 61 on the liquid container 14 side and a second flow path R2 which communicates with the liquid supply flow path 61 on the common liquid chamber SR side, and controls on-off (closing-opening) of the first flow path R1 according to a pressure (negative pressure) in the second flow path R2. Specifically, when it is a normal operation state in which a pressure in the second flow path R2 is in a predetermined range (state in which pressure adjusting function of pressure adjusting valve 70 is operated), the valve unit 71 shuts off the first flow path R1 and the second flow path R2, and for example, when a pressure in the second flow path R2 drops due to ejecting of ink using the liquid ejecting head 30, or suctioning of ink from the outside, the valve unit 71 causes the first flow path R1 and the second flow path R2 to communicate with each other. In the state in which the first flow path R1 and the second flow path R2 communicate with each other, ink which is supplied to the first flow path R1 from the liquid container 14 through the liquid supply flow path 61 flows in the second flow path R2 through the valve unit 71, and is supplied to the liquid ejecting head 30. That is, the first flow path R1 is located on the upstream side of the valve unit 71, and the second flow path R2 is located on the downstream side of the pressure adjusting valve 70.

The pressure adjusting valve 70 includes a support body 72, a sealing body 74, and a sealing body 76. The sealing body 74 is fixed to a surface on one side of the flat-plate shaped support body 72, and the sealing body 76 is fixed to a surface on the other side of the support body 72. A recessed portion 722 in an approximately circular shape in a planar view is formed on the surface of the support body 72 on the sealing body 74 side, and a recessed portion 724 in an approximately circular shape is similarly formed on the surface of the support body 72 on the sealing body 76 side. A space which is surrounded with the recessed portion 722 and the sealing body 74 functions as the first flow path R1, and a space which is surrounded with the recessed portion 724 and the sealing body 76 functions as the second flow path R2. The first flow path R1 communicates with the liquid supply flow path 61 (and liquid container 14), and the second flow path R2 communicates with the common liquid chamber SR.

The sealing body 76 is a thin plate-shaped member (film shape) which is formed of a resin material such as polypropylene, for example, and is welded or bonded to the surface of the support body 72. A portion of the sealing body 76 which is located inside the recessed portion 724 in a planar view is referred to as a movable unit 762 here. A pressure receiving plate 78 is provided on the surface of the movable unit 762 on the support body 72 side. The pressure receiving plate 78 is a flat-plate member which is approximately circular, for example.

The valve unit 71 includes a valve 82, a valve seat 84, a spring S1, and a spring S2. Schematically, when the valve 82 moves to a positive side and a negative side in the W direction with respect to the valve seat 84, on-off of the first flow path R1 (shutting off-communicating between first flow path R1 and second flow path R2) is switched. That is, when the valve 82 moves to the positive side in the W direction with respect to the valve seat 84, the first flow path R1 and the second flow path R2 are shut off. In contrast to this, when the valve 82 moves to the negative side in the W direction with respect to the valve seat 84, the first flow path R1 and the second flow path R2 are caused to communicate with each other.

The valve seat 84 is a portion of the support body 72 which is located between the first flow path R1 and the second flow path R2 (base of recessed portion 722 or recessed portion 724), and faces the movable unit 762 of the sealing body 76 with an interval. A through hole H which penetrates the support body 72 is formed at approximately a center of the valve seat 84. The through hole H is a round foramen of which the inner peripheral face is parallel to the W direction. The first flow path R1 which is located on the upstream side of the valve seat 84, and the second flow path R2 which is located on the downstream side of the valve seat 84 communicate with each other through the through hole H of the valve seat 84.

The valve 82 is provided in the first flow path R1. The valve 82 is formed of a base portion 822, a sealing unit 824, and a valve stem 826. The base portion 822 is a flat plate-shaped portion which is molded in a circular shape with an outer diameter which exceeds an inner diameter of the through hole H. The valve stem 826 vertically projects from the surface of the base portion 822 in the same axis, and the annular sealing unit 824 which surrounds the valve stem 826 in a planar view is provided on the surface of the base portion 822. The valve 82 is provided so that the base portion 822 and the sealing unit 824 are located in the first flow path R1, in a state in which the valve stem 826 which faces an axis line C in the W direction is inserted into the through hole H of the valve seat 84. An interval is formed between the inner peripheral face of the through hole H of the valve seat 84 and the outer peripheral face of the valve stem 826. The spring S1 urges the valve 82 which is provided between the sealing body 74 and the base portion 822 of the valve 82 to the valve seat 84 side. On the other hand, the spring S2 is provided between the valve seat 84 and the pressure receiving plate 78 (movable unit 762).

The sealing unit 824 of the valve 82 is located between the base portion 822 and the valve seat 84, and functions as a seal which closes the through hole H by being in contact with the valve seat 84. Specifically, the sealing unit 824 comes into contact with the surface S on the first flow path R1 side of the valve seat 84 (hereinafter, referred to as "sealing face").

According to the pressure adjusting valve 70 with such a configuration, in a normal operation state in which a pressure in the second flow path R2 is maintained in a predetermined range, since a periphery edge portion of the sealing unit 824 comes into contact with the sealing face S of the valve seat 84 when the spring S1 urges the valve 82, a state in which the valve 82 closes the through hole H of the valve seat 84 (hereinafter, referred to as "closed state") is maintained as denoted by a one-dot dashed line in FIG. 10. That is, the first flow path R1 and the second flow path R2 are shut off. In contrast to this, for example, when a pressure in the second flow path R2 drops due to ejecting of ink or suctioning from the outside, as denoted by a solid line in FIG. 10, the movable unit 762 of the sealing body 76 is displaced to the valve seat 84 side, the pressure receiving plate 78 which is provided in the movable unit 762 presses the valve stem 826 of the valve 82 against urging of the spring S2. That is, the movable unit 762 functions as a diaphragm which is displaced according to a pressure (negative pressure) in the second flow path R2. When the pressure in the second flow path R2 further drops, as denoted by the solid line in FIG. 10, the sealing unit 824 is changed to a state of being separated from the valve seat 84 (hereinafter, referred to as "open state") when the valve stem 826 is pressed by the movable unit 762 (pressure receiving plate 78), the valve 82 moves to the negative side (sealing body 74 side) in the W direction against urging of the spring S1. In the open state, the through hole H of the valve seat 84 is open, and the first flow path R1 and the second flow path R2 communicate with each other through the through hole H.

According to the pressure adjusting valve 70, in a non-printing state, that is, in a state in which ink is not consumed, the valve unit 71 enters a closed state even when ink is pressure-fed from the liquid pressure-feeding unit 66 on the upstream side of the pressure adjusting valve 70. In this manner, ink from the liquid pressure-feeding unit 66 is not supplied to the common liquid chamber SR on the downstream side of the pressure adjusting valve 70.

In contrast to this, ink which is temporarily stored in the common liquid chamber SR in a printing state is ejected from a nozzle N through the pressure chamber SC, and when ink is consumed, a pressure drops along with a decrease of ink in the second flow path R2, and it becomes a negative pressure in the second flow path R2. Due to this, since the movable unit 762 is displaced to the negative side in the W direction in which the valve 82 is pushed down, the valve unit 71 enters an open state, and ink is supplied to the second flow path R2 from the first flow path R1. In this manner, ink from the liquid pressure-feeding unit 66 is supplied to the common liquid chamber SR. In addition, when the negative pressure of the second flow path R2 is resolved due to flowing in of ink to the second flow path R2 of the pressure adjusting valve 70, as denoted by the one-dot dashed line in FIG. 10, the movable unit 762 is displaced to a positive side in the W direction, the valve unit 71 enters the closed state again due to returning of the valve 82, and supplying of ink to the common liquid chamber SR is stopped.

In this manner, in a printing operation, the valve unit 71 operates so as to sequentially supply ink to the second flow path R2 while being slightly opened according to consuming of ink. That is, a pressure change of ink in the second flow path R2 on the downstream side is limited so as to be in a certain range due to on-off of the valve unit 71, and is separated from a pressure change of ink in the first flow path R1 on the upstream side. Accordingly, even when there is a pressure change on the upstream side of the pressure adjusting valve 70, the downstream side is not influenced by the pressure change. For this reason, supplying of ink from the second flow path R2 to the common liquid chamber SR is preferably performed.

In the normal operation state (non-printing state and printing state) in which a pressure adjusting function using the pressure adjusting valve 70 is operated, since the valve is opened or closed so that ink is automatically replenished only when ink in the common liquid chamber SR is reduced, the downstream side (common liquid chamber SR side) of the pressure adjusting valve 70 is limited so as to be usually in a certain range.

However, when ink in the liquid supply flow path 61 is forcibly pressurized using the pressurizing unit 62 of the second pressurizing unit 60 at a time of the pressurizing wiping operation, a pressure in the second flow path R2 in the pressure adjusting valve 70 which communicate therewith increases. For this reason, since the movable unit 762 moves to a positive side in the W direction as dented by a dashed line in FIG. 10 while the valve 82 is closed as denoted by the one-dot dashed line in FIG. 10, an effect of increasing a pressure using the pressurizing unit 62 of the second pressurizing unit 60 decreases. In addition, there also is a possibility that the sealing body 76 and the support body 72 are separated.

In this point, according to the second pressurizing unit 60 illustrated in FIG. 9, it is possible to set so that the pressure adjusting function in which a valve is open according to a pressure change on the downstream side is not operated, temporarily, by shutting off the pressure adjusting valve 70 by closing the on-off valve 64 between the pressurizing unit 62 and the pressure adjusting valve 70. For this reason, it is possible to pressurize ink in the liquid supply flow path 61 on the downstream side using the on-off valve 64, without being influenced by the pressure adjusting valve 70, by performing pressurizing using the pressurizing unit 62 after closing the on-off valve 64. In this manner, it is possible to increase a pressurizing effect using the second pressurizing unit 60. In addition, it is possible to reduce a possibility that the sealing body 76 and the support body 72 may be separated. In addition, it is possible to cause the pressure adjusting function of the pressure adjusting valve 70 to return by opening the on-off valve 64 when the pressurizing wiping operation is finished.

Figure 11:
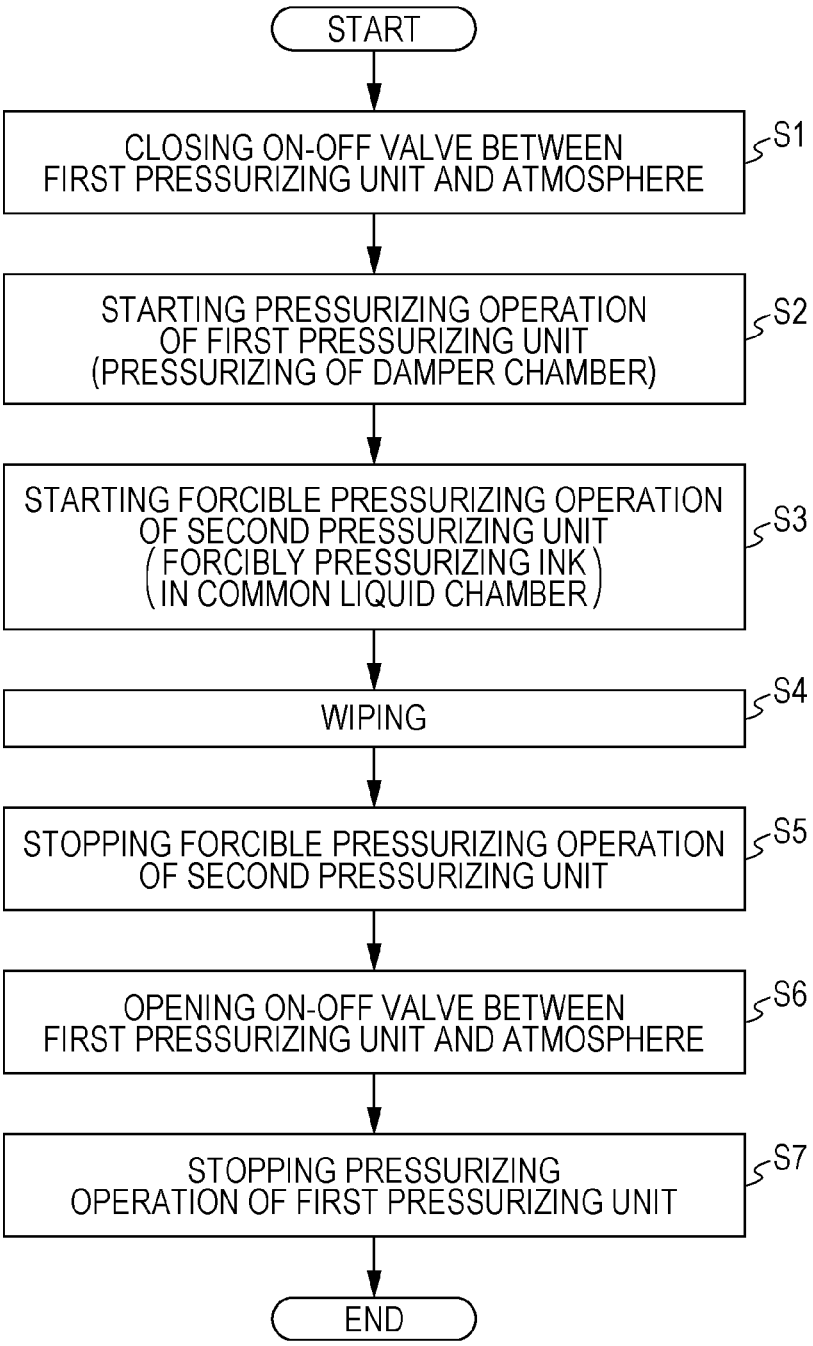
FIG. 11 is a flowchart which illustrates a specific example of a pressurizing wiping operation according to the embodiment.

Subsequently, the pressurizing wiping operation which is performed using the pressurizing mechanism in the embodiment will be described. FIG. 11 is a flowchart for describing the pressurizing wiping operation in the embodiment. The pressurizing wiping operation is executed according to a program using the control device 22. As illustrated in FIG. 11, first, in step S1, the control device 22 performs pressurizing of the damper chamber SD by starting a pressurizing operation of the first pressurizing unit 50 in step S2 after closing the on-off valve 59 between the first pressurizing unit 50 and atmosphere. It is possible to pressurize the damper chamber SD using the first pressurizing unit 50, after setting the damper chamber SD to a closed space which is shut off from atmosphere by closing the on-off valve 59 in this manner. In this manner, it is possible to increase pressurizing efficiency of the damper chamber SD compared to a case in which the damper chamber SD is pressurized using the first pressurizing unit 50 without being shut off from atmosphere.

Subsequently, in step S3, the control device 22 forcibly pressurizes ink in the common liquid chamber SR by starting a forcible pressurizing operation of the second pressurizing unit 60. In this state, in step S4, the control device 22 performs wiping of the ejecting face by driving the wiping device 28. In this manner, it is possible to perform wiping of the ejecting face while causing ink to be oozed out from a nozzle N. In this manner, it is possible to prevent ink or bubble from entering into the nozzle N when wiping the ejecting face. Moreover, it is possible to suppress excessive bending of the flexible film 472 while performing the wiping operation, since the ejecting face is wiped using the wiping device 28 in the middle of pressurizing the damper chamber SD using the first pressurizing unit 50.

When the wiping is finished, in step S5, the forcible pressurizing operation using the second pressurizing unit 60 is stopped, and the state returns to the normal operation state (non-printing state or printing state). When the pressurizing unit 62 illustrated in FIG. 9 is configured similarly to that in FIG. 8, it is possible to stop the forcible pressurizing operation using the second pressurizing unit 60 by returning the movable unit 542 of the sealing body 54 to the positive side in the W direction by rotating the eccentric cam 56. Subsequently, in step S6, the control device 22 stops the pressurizing operation of the first pressurizing unit 50 in step S7, after opening the on-off valve 59 between the first pressurizing unit 50 and atmosphere. Specifically, the movable unit 542 of the sealing body 54 is returned to the positive side in the W direction by rotating the eccentric cam 56 which is illustrated in FIG. 8. In this manner, a pressure in the damper chamber SD is reduced, and returns to atmospheric pressure.

Meanwhile, if the on-off valve 59 is not open when pressurizing of the damper chamber SD is finished, a pressure in the damper chamber SD decreases from the time of stopping the pressurizing operation of the first pressurizing unit 50. For this reason, if water vapor of the damper chamber SD is saturated at a time of pressurizing, when a pressure in the damper chamber SD decreases in a state in which the on-off valve 59 is not open, there is a concern that dew condensation may occur. In this point, according to FIG. 11, it is possible to cause water vapor to escape by opening the damper chamber SD to atmosphere before stopping the pressurizing operation of the first pressurizing unit 50, since the pressurizing operation of the first pressurizing unit 50 is stopped in step S7 after opening the on-off valve 59 in step S6.

In this manner, in the pressurizing wiping operation according to the embodiment, it is possible to prevent the flexible film 472 of the damper chamber SD from being excessively bent, since ink in the common liquid chamber SR is forcibly pressurized using the second pressurizing unit 60 in step S3 after pressurizing the damper chamber SD using the first pressurizing unit 50 in step S2 which is illustrated in FIG. 11. In addition, since it is also possible to set the flexible film 472 to be rarely bent by pressurizing the damper chamber SD using the first pressurizing unit 50, a pressurizing effect of the common liquid chamber SR can be increased, and a response can be improved. In addition, it is possible to avoid bending of the flexible film 472 toward the damper chamber SD side due to pressurizing of the second pressurizing unit 60, when finishing pressurizing of the damper chamber SD in steps S6 and S7, by stopping the forcible pressurizing operation of the second pressurizing unit 60 in step S5, before steps S6 and S7.

In addition, in FIG. 11, step S6 and step S7 may be reversed. That is, the on-off valve 59 between the first pressurizing unit 50 and atmosphere may be opened, after stopping the pressurizing operation of the first pressurizing unit 50. If water vapor of the damper chamber SD is saturated, since it is possible to cause the water vapor escape by being exposed to atmosphere, by opening the on-off valve 59, there is a concern that moisture loss from the common liquid chamber SR through the flexible film 472 may progress that much. In this point, it is possible to finish pressurizing of the damper chamber SD while suppressing escaping of water vapor by being exposed to atmosphere, by opening the on-off valve 59 between the first pressurizing unit 50 and atmosphere after stopping the pressurizing operation of the first pressurizing unit 50.

In addition, in the embodiment, the case in which ink in the common liquid chamber SR is forcibly pressurized using the second pressurizing unit 60 is described; however, it is not limited to this. Since it is possible to suppress bending of the flexible film 472 by pressurizing the damper chamber SD using the first pressurizing unit 50, it is also possible to forcibly pressurize ink by changing a volume in the common liquid chamber SR using the fact. In this case, the forcible pressurizing operation of the second pressurizing unit 60 may be set so as not to function in the middle of the pressurizing operation of the first pressurizing unit 50, by providing an on-off function in the second pressurizing unit 60.

For example, when the pressurizing unit 62 has the configuration illustrated in FIG. 8, the on-off function of the pressurizing unit 62 may be executed by controlling the eccentric cam 56. Specifically, when the pressurizing unit 62 is off, a situation in which the sealing body 54 is pressed to the negative side in the W direction using the eccentric cam 56 is taken into consideration. In this manner, it is possible to set so that the sealing body 54 of the pressurizing unit 62 is not displaced even when the common liquid chamber SR is pressurized. In this case, it is preferable that the on-off valve 64 is closed so as not to be influenced by the pressure adjusting valve 70, as well, in the middle of the pressurizing operation of the first pressurizing unit 50. In addition, in this manner, when ink in the common liquid chamber SR is pressurized due to the pressurizing operation of the first pressurizing unit 50, the second pressurizing unit 60 with the forcible pressurizing function may not be provided. In this case, only the liquid pressure-feeding unit 66 and the pressure adjusting valve 70 may be connected to the common liquid chamber SR, in order to perform a normal operation of a non-printing state and a printing state.

Modification Example

Each embodiment which is exemplified above can be variously modified. Specific modification examples will be exemplified below. Two or more modes which are arbitrarily selected from the following examples can be appropriately combined as long as they are not contradictory to each other.

Figure 12:
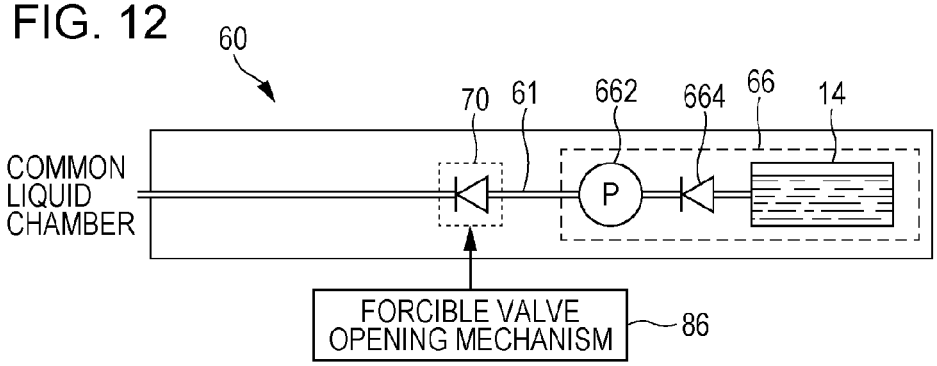
FIG. 12 is a block diagram which describes a modification example of the first pressurizing unit according to the embodiment.

(1) In the embodiment, the case in which, when performing a pressurizing wiping operation, or the like, the pressurizing unit 62 illustrated in FIG. 9 is provided as the second pressurizing unit 60 which pressurizes ink in the common liquid chamber SR, and ink is forcibly pressurized using the pressurizing unit 62 is exemplified; however, it is not limited to this. As the second pressurizing unit 60, a configuration in which the inside of the common liquid chamber SR is forcibly pressurized through ink which is pressurized using a pressurizing pump 662 of the liquid pressure-feeding unit 66 without using the pressurizing unit 62 may be adopted. For example, as illustrated in FIG. 12, a configuration in which ink in the common liquid chamber SR is pressurized by forcibly opening the pressure adjusting valve 70 by providing a forcible valve opening mechanism 86 in the pressure adjusting valve 70 may be adopted.

Figure 13:
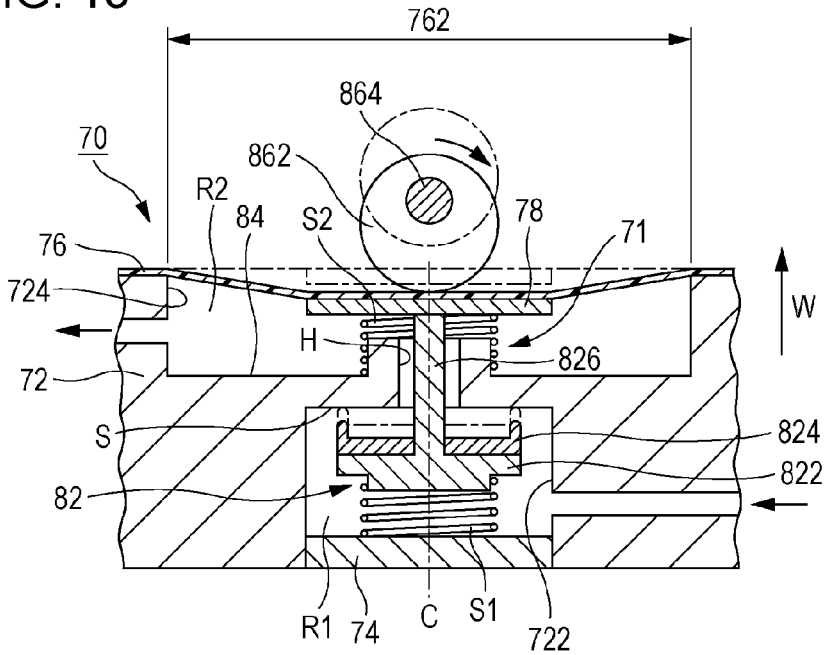
FIG. 13 is a sectional view which illustrates a specific configuration example of a pressurizing adjusting valve illustrated in FIG. 12.

A specific configuration example of the pressure adjusting valve 70 which includes such a forcible valve opening mechanism 86 is illustrated in FIG. 13. The pressure adjusting valve 70 illustrated in FIG. 13 is obtained by providing an operation eccentric cam mechanism which opens the valve 82 by pressing down the valve by forcibly displacing the sealing body 76, as the forcible valve opening mechanism 86, in the pressure adjusting valve 70 illustrated in FIG. 10. The eccentric cam mechanism here is configured similarly to that which is illustrated in FIG. 8, for example. Specifically, an eccentric cam 862 is arranged so as to face the pressure receiving plate 78 of the sealing body 76. The eccentric cam 862 is attached to a driving rod 864 which is rotatably driven, by being suspended on a direction perpendicular to the W direction in an eccentric manner.

The eccentric cam 862 rotates using the driving rod 864, and performs an operation of pressing the pressure receiving plate 78 to the first flow path R1 side. Due to the operation, the movable unit 762 of the sealing body 76 is also displaced in the same direction, and the valve 82 enters an open state by being pressed down to the negative side in the W direction (state denoted by solid line in FIG. 13). In this manner, it is possible to cause the liquid supply flow path 61 between the liquid pressure-feeding unit 66 and the common liquid chamber SR to be communicated forcibly, regardless of a pressure of the pressure adjusting valve 70 on the downstream side. In this manner, it is possible to forcibly pressurize the inside of the common liquid chamber SR through ink which is pressurized by the pressurizing pump 662 of the liquid pressure-feeding unit 66. In addition, the movable unit 762 of the sealing body 76 is returned to the positive side in the W direction by separating the eccentric cam 862 from the movable unit 762 of the sealing body 76, as denoted by a one-dot dashed line in FIG. 13, by rotating the eccentric cam 862. In this manner, a position of the valve 82 returns to the positive side in the W direction, and it is possible to return the pressure adjusting function of the pressure adjusting valve 70 which configures the second pressurizing unit 60.

The forcible valve opening mechanism 86 may have any configuration without being limited to the eccentric cam mechanism which is illustrated in FIG. 13, as long as it is possible to open the valve 82 by pressing down the valve, by forcibly displacing the sealing body 76. For example, as the forcible valve opening mechanism 86, it is also possible to use a link mechanism, an electromagnetic plunger, an actuator which is driven using a pressure of air, or the like.

Figure 14:
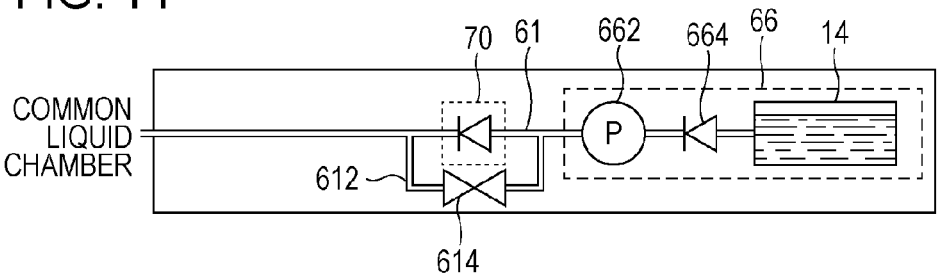
FIG. 14 is a block diagram which describes another modification example of the first pressurizing unit according to the embodiment.

(2) The configuration of the second pressurizing unit 60 in which ink in the common liquid chamber SR can be pressurized using the pressurizing pump 662 is not limited to the above described configurations which are illustrated in FIGS. 12 and 13. For example, as illustrated in FIG. 14, it may be a configuration in which an on-off valve 614 is provided in a bypass flow path 612, by providing the bypass flow path 612 which bypasses the pressure adjusting valve 70 in the liquid supply flow path 61. In this manner, it is possible to cause the liquid supply flow path 61 between the liquid pressure-feeding unit 66 and the common liquid chamber SR to be forcibly communicated not through the pressure adjusting valve 70 by opening the on-off valve 614 using the second pressurizing unit 60. In this manner, it is also possible to forcibly pressurize the inside of the common liquid chamber SR through ink which is pressurized by the pressurizing pump 662 of the liquid pressure-feeding unit 66.

(3) In each embodiment which is described above, a line head in which the plurality of liquid ejecting heads 30 are arranged over the entire width of the medium 12 is exemplified; however, it is also possible to apply the invention to a serial head in which a carriage in which a liquid ejecting head 30 is mounted is repeatedly reciprocated along the X direction. In addition, a method of ejecting ink using the liquid ejecting unit 32 is not limited to the above described method (piezoelectric method) in which a piezoelectric elements is used. The invention can be applied to a liquid ejecting head in which a method of using a heating element which changes a pressure in a pressure chamber by generating bubbles in the pressure chamber using heating (thermal method) is adopted, for example.

(4) The printing apparatus 10 which is exemplified in each of the embodiments can be adopted to various devices such as a fax machine, a copy machine, or the like, in addition to an exclusive device for printing. Originally, a use of the liquid ejecting apparatus in the invention is not limited to printing. For example, a liquid ejecting apparatus which ejects a solution of a coloring material is used as a manufacturing device which forms a color filter of a liquid crystal display device. In addition, a liquid ejecting apparatus which ejects a solution of a conductive material is used as a manufacturing device which forms wiring or an electrode of a wiring substrate.

What is claimed is:

1. A liquid ejecting apparatus comprising:

a liquid ejecting unit including:

a plurality of pressure chambers which generate a pressure for ejecting liquid from a nozzle, wherein the plurality of pressure chambers are positioned next to a first side of a flow path member;

a common liquid chamber which stores liquid which is supplied to the plurality of pressure chambers;

a flexible film which configures a part of a wall face of the common liquid chamber; and a damper chamber which is partitioned from the common liquid chamber using the flexible film, wherein the damper chamber is positioned next to a second side of the flow path member;

a first pressurizing unit which pressurizes the damper chamber, and a second pressurizing unit which pressurizes liquid which is supplied to the common liquid chamber.

2. The liquid ejecting apparatus according to claim 1, wherein pressurizing of the damper chamber using the first pressurizing unit is performed before pressurizing using the second pressurizing unit.

3. The liquid ejecting apparatus according to claim 1, further comprising:

an atmosphere opening port which causes an inside of the damper chamber to communicate with atmosphere; and an on-off valve which is provided between the damper chamber and the atmosphere opening port.

4. The liquid ejecting apparatus according to claim 1, further comprising:

an atmosphere opening port which causes an inside of the damper chamber to communicate with atmosphere; and an on-off valve which is provided between the damper chamber and the atmosphere opening port.

5. The liquid ejecting apparatus according to claim 2, further comprising:

an atmosphere opening port which causes an inside of the damper chamber to communicate with atmosphere; and an on-off valve which is provided between the damper chamber and the atmosphere opening port.

6. The liquid ejecting apparatus according to claim 3, wherein pressurizing of the damper chamber using the first pressurizing unit is performed after closing the on-off valve.

7. The liquid ejecting apparatus according to claim 4, wherein pressurizing of the damper chamber using the first pressurizing unit is performed after closing the on-off valve.

8. The liquid ejecting apparatus according to claim 5, wherein pressurizing of the damper chamber using the first pressurizing unit is performed after closing the on-off valve.

9. The liquid ejecting apparatus according to claim 3, wherein, when finishing pressurizing of the damper chamber, a pressurizing operation of the first pressurizing unit is stopped after opening the on-off valve.

10. The liquid ejecting apparatus according to claim 6, wherein, when finishing pressurizing of the damper chamber, a pressurizing operation of the first pressurizing unit is stopped after opening the on-off valve.

11. The liquid ejecting apparatus according to claim 3, wherein, when finishing pressurizing of the damper chamber, the on-off valve is opened after stopping the pressurizing operation of the first pressurizing unit.

12. The liquid ejecting apparatus according to claim 6, wherein, when finishing pressurizing of the damper chamber, the on-off valve is opened after stopping the pressurizing operation of the first pressurizing unit.

13. The liquid ejecting apparatus according to claim 1, further comprising:

a wiping unit which wipes an ejecting face on which a plurality of nozzles are provided, wherein the ejecting face is wiped using the wiping unit in the middle of pressurizing the damper chamber using the first pressurizing unit.

14. The liquid ejecting apparatus according to claim 1, further comprising:

a wiping unit which wipes an ejecting face on which a plurality of nozzles are provided, wherein the ejecting face is wiped using the wiping unit in the middle of pressurizing the damper chamber using the first pressurizing unit.

15. The liquid ejecting apparatus according to claim 2, further comprising:

a wiping unit which wipes an ejecting face on which a plurality of nozzles are provided, wherein the ejecting face is wiped using the wiping unit in the middle of pressurizing the damper chamber using the first pressurizing unit.

16. The liquid ejecting apparatus according to claim 3, further comprising:

a wiping unit which wipes an ejecting face on which a plurality of nozzles are provided, wherein the ejecting face is wiped using the wiping unit in the middle of pressurizing the damper chamber using the first pressurizing unit.

17. The liquid ejecting apparatus according to claim 6, further comprising:

a wiping unit which wipes an ejecting face on which a plurality of nozzles are provided, wherein the ejecting face is wiped using the wiping unit in the middle of pressurizing the damper chamber using the first pressurizing unit.

18. The liquid ejecting apparatus according to claim 9, further comprising:

a wiping unit which wipes an ejecting face on which a plurality of nozzles are provided, wherein the ejecting face is wiped using the wiping unit in the middle of pressurizing the damper chamber using the first pressurizing unit.

19. The liquid ejecting apparatus according to claim 11, further comprising:

a wiping unit which wipes an ejecting face on which a plurality of nozzles are provided, wherein the ejecting face is wiped using the wiping unit in the middle of pressurizing the damper chamber using the first pressurizing unit.

20. The liquid ejecting apparatus according to claim 1, wherein, the damper chamber is pressurized during a wiping operation and is open to atmosphere during a normal printing state of the liquid ejecting apparatus.

21. The liquid ejecting apparatus of claim 1, wherein the second pressurizing unit is in a liquid supply flow path that is situated between the common liquid chamber and a liquid container, and wherein the liquid ejecting apparatus further includes a check valve that is interposed between the liquid container and the second pressurizing unit.

* * * * *